US011201018B2

(12) United States Patent
Hoffmann et al.

(10) Patent No.: US 11,201,018 B2
(45) Date of Patent: Dec. 14, 2021

(54) ELECTROMECHANICAL SWITCHING DEVICE COMPRISING SWITCHING CONTACTS

(71) Applicant: Phoenix Contact GmbH & Co. KG, Blomberg (DE)

(72) Inventors: Ralf Hoffmann, Berlin (DE); Thomas Gundlach, Hohen Neuendorf (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 29 days.

(21) Appl. No.: 16/496,629

(22) PCT Filed: Mar. 22, 2018

(86) PCT No.: PCT/EP2018/000106
§ 371 (c)(1),
(2) Date: Sep. 23, 2019

(87) PCT Pub. No.: WO2018/171938
PCT Pub. Date: Sep. 27, 2018

(65) Prior Publication Data

US 2020/0381187 A1 Dec. 3, 2020

(30) Foreign Application Priority Data

Mar. 23, 2017 (DE) ..... 10 2017 106 237.8

(51) Int. Cl.
*H01H 1/02* (2006.01)
*H01H 1/06* (2006.01)
*H01H 1/66* (2006.01)

(52) U.S. Cl.
CPC ..... *H01H 1/06* (2013.01); *H01H 1/02* (2013.01); *H01H 1/66* (2013.01); *H01H 2201/024* (2013.01); *H01H 2201/026* (2013.01)

(58) Field of Classification Search
CPC .. H01H 1/06; H01H 1/02; H01H 1/40; H01H 1/60; H01H 2201/024; H01H 2201/026; H01H 2050/025
(Continued)

(56) References Cited

U.S. PATENT DOCUMENTS 3,671,314 A * 6/1972 Gackstetter ..... H01H 1/021 427/532
4,399,339 A 8/1983 Storm
(Continued)

FOREIGN PATENT DOCUMENTS

CN 1519991 A 8/2004
CN 1722532 A 1/2006
(Continued)

*Primary Examiner* — William A Bolton
(74) *Attorney, Agent, or Firm* — Holland & Hart LLP

(57) ABSTRACT

The present disclosure relates to an electromechanical switching device comprising switching contacts configured to close an electrical circuit, wherein the switching contacts have a first switching contact and a second switching contact, wherein the first switching contact and the second switching contact can be brought into contact in order to close the electrical circuit, wherein at least one of the switching contacts s formed from a plurality of closed bodies which are arranged against one another, and wherein hollow spaces for receiving liquid are arranged between the closed bodies.

16 Claims, 3 Drawing Sheets

(58) Field of Classification Search
USPC ..... 200/502, 512, 511, 264
See application file for complete search history.

(56) References Cited

U.S. PATENT DOCUMENTS

| | | | | |
|---|---|---|---|---|
| 5,967,303 | A * | 10/1999 | Kurek | H01H 23/20 200/559 |
| 7,321,281 | B2 * | 1/2008 | Molyneux | H01H 50/023 335/202 |
| 7,365,280 | B2 * | 4/2008 | Nishikawa | B60Q 1/441 200/279 |
| 7,528,337 | B2 * | 5/2009 | Tanabe | G01L 1/20 200/511 |
| 7,843,289 | B1 * | 11/2010 | Raklyar | H01P 1/11 335/4 |
| 2005/0074934 | A1 * | 4/2005 | Guyot | C25D 5/022 438/200 |
| 2016/0172140 | A1 * | 6/2016 | Eismann | H01H 1/027 200/268 |

FOREIGN PATENT DOCUMENTS

| | | | |
|---|---|---|---|
| CN | 101359555 | A | 2/2009 |
| DE | 3203893 | A1 | 10/1982 |
| DE | 10116894 | A1 | 10/2002 |
| DE | 69735101 | T2 | 9/2006 |
| GB | 2094062 | A | 9/1982 |
| JP | S 57-157409 | A | 9/1982 |
| JP | 2002-509604 | A | 3/2002 |
| JP | 2007-179999 | A | 7/2007 |

* cited by examiner

ELECTROMECHANICAL SWITCHING DEVICE COMPRISING SWITCHING CONTACTS

CROSS-REFERENCES TO RELATED APPLICATIONS

This application is a 371 national phase entry of International Patent Application No. PCT/EP2018/000106, entitled "ELECTROMECHANICAL SWITCHING DEVICE COMPRISING SWITCHING CONTACTS," filed 22 Mar. 2018, which claims priority to German Patent Application No. 10 2017 106 237.8, entitled "ELEKTROMECHANISCHES SCHALTGERÄT MIT SCHALTKONTAKTEN, filed 23 Mar. 2017. Each of these applications is incorporated herein by reference.

TECHNICAL FIELD

The present disclosure relates to an electromechanical switching device comprising switching contacts for closing an electrical circuit, in particular a relay with relay contacts.

BACKGROUND

Different types of electromechanical switching devices, in particular relays, are used in different applications. A typical application in the industrial sector is the control of electrical loads, which can be resistive, inductive or capacitive consumers. If a switching contact is closed at the voltage maximum or opened at the current maximum, an undesired switch arc can occur over the opened switching contact. The switch arc depends on the switched-off electrical load, the geometric properties and the material properties of the switching contact, as well as the opening speed of the switching contact. The switch arc can have a temperature between 5000 Kelvin and 15,000 Kelvin. If the switch arc has a sufficiently high temperature, a chemical reaction of the ambient air can occur, wherein nitric acid can be produced. The resulting nitric acid can accumulate on the switching contacts and possibly chemically react with the metallic switching contacts.

It is therefore the object of the present disclosure to provide an improved electromechanical switching device.

This object is achieved by the features of the independent claim. Advantageous examples of the principles of the present disclosure are the subject matter of the dependent claims, the description and the accompanying figures.

The principles of the present disclosure are based on the knowledge that in order to reduce the accumulation of liquid between the first switching contact and the second switching contact of an electromechanical switching device, at least one of the switching contacts has hollow spaces in which liquid can be received. Through an occurring capillary action, the liquid advantageously enters the hollow spaces. The hollow spaces within the at least one switching contact provide a sufficiently large volume for the liquid so that the amount of liquid remaining between the first switching contact and the second switching contact can be significantly reduced.

According to one aspect, the present disclosure relates to an electromechanical switching device comprising switching contacts for closing an electrical circuit, in particular a relay with relay contacts, wherein the switching contacts comprise a first switching contact and a second switching contact, wherein the first switching contact and the second switching contact can be brought into contact in order to close the electrical circuit, wherein at least one of the switching contacts is formed from a plurality of closed bodies arranged against one another, and wherein hollow spaces for receiving liquid are arranged between the closed bodies.

At least one of the switching contacts, in particular one of the switching contacts or both switching contacts, are formed from a plurality of closed bodies arranged against one another. The closed bodies can have various geometric structures, such as pyramids, tetrahedrons, drop-shaped bodies, spheroids, macaroon-shaped bodies and/or spherical bodies and/or mixtures thereof. In this case, the closed bodies abut against one another and form a layer structure within the switching contact. This ensures a stable electrically conductive structure of the first and/or second switching contact.

Because, due to their own geometric shape, the closed bodies do not fill the volume of the at least one switching contact, hollow spaces are configured within the switching contact between the closed bodies arranged against one another. The hollow spaces serve to receive liquid, whereby the amount of liquid accumulating between the first switching contact and the second switching contact can be reduced. In addition, the closed bodies arranged against one another allow small adhesive forces to occur between the first switching contact and the second switching contact.

In one example, the first switching contact has a first switching contact surface and the second switching contact has a second switching contact surface, wherein the first switching contact surface and the second switching contact surface can be brought into contact in order to close the electrical circuit, and wherein the first switching contact surface and/or the second switching contact surface have at least one rounded surface, at least one edge, at least one tip and/or at least one edge with at least one tip.

A rounded surface, an edge, a tip and/or an edge with at least one tip on the first switching contact surface and/or on the second switching contact surface reduces the total area of the contact region between the first switching contact and the second switching contact, whereby particularly low adhesive forces occur between the switching contacts.

In one example, the closed bodies are configured as pyramids, tetrahedrons, drop-shaped bodies, spheroids, macaroon-shaped bodies and/or spherical bodies, in particular spherical bodies.

By arranging pyramids, tetrahedrons, drop-shaped bodies, spheroids, macaroon-shaped bodies and/or spherical bodies in the at least one switching contact, hollow spaces remain between the closed bodies, wherein the hollow spaces can effectively receive liquid. The closed bodies are configured, in particular, as spherical bodies, because a large total volume of the hollow spaces can thus be provided within the at least one switching contact.

In one example, the closed bodies have body contact surfaces, wherein the body contact surfaces of the closed bodies arranged against one another are in contact inside the first switching contact and/or the second switching contact in order to delimit the hollow spaces between the closed bodies arranged against one another.

Inside the switching contact, the closed bodies form a dense package of closed bodies, wherein the body contact surfaces of the closed bodies are in contact with the corresponding body contact surfaces of the adjacent closed bodies. The body contact surfaces of the closed bodies arranged inside the first and/or second switching contact effectively delimit the hollow spaces.

In one example, the hollow spaces between the closed bodies are configured as capillary columns, wherein the capillary columns are configured to retain liquid in the capillary columns through a capillary action.

The capillary action is caused by the surface tension of the liquid and by the interfacial tension between the liquid and the surface of the closed bodies. Particularly with small radii of the closed bodies, a particularly advantageous capillary action occurs, whereby the liquid is effectively received in the hollow spaces. This allows an effective receiving of the liquid in the capillary columns even in the case of higher viscous liquids, such as nitric acid.

In one example, the at least one switching contact is configured as a pyramid, which comprises a pyramid tip for closing the electrical circuit, wherein the pyramid is formed from several layers of closed bodies arranged against one another, wherein the pyramid is in particular configured as a tetrahedron, a square pyramid, a five-sided pyramid or a six-sided pyramid.

A pyramid ensures an effective layer arrangement of the closed bodies in the switching contact, wherein the pyramid tip provides a reduced switching contact surface for closing the electrical circuit.

In one example, the at least one switching contact is configured as a cone, which comprises a cone tip for closing the electrical circuit, wherein the cone is formed from several layers of closed bodies arranged against one another, or wherein the at least one switching contact is configured as a cone, which comprises a cone top surface for closing the electrical circuit, wherein the cone is formed from several layers of closed bodies arranged against one another.

A cone ensures an effective layer arrangement of the closed bodies in the at least one switching contact, wherein the cone tip, or cone top surface, provides a reduced switching contact surface for closing the electrical circuit.

In one example, the at least one switching contact is configured as a double cone, which comprises a first cone with a first cone tip for closing the electrical circuit and a second cone with a second cone tip for closing the electrical circuit.

A double cone can ensure a dense package of the closed bodies and an effective contact of the switching contacts for closing the electrical circuit.

In one example, each switching contact is formed from a plurality of closed bodies arranged against one another, and hollow spaces for receiving liquid are arranged between the closed bodies.

As a result of both the first switching contact and the second switching contact being formed from closed bodies arranged against one another, a large number of hollow spaces for receiving liquid is provided both in the first switching contact and in the second switching contact.

In one example, only one of the switching contacts is formed from a plurality of closed bodies arranged against one another, wherein hollow spaces for receiving liquid are arranged between the closed bodies, wherein the other switching contact is configured as a massive switching contact which does not comprise any hollow spaces for receiving liquid, wherein the massive switching contact is in particular configured as a switching contact plate or as a switching contact bar.

It can be sufficient in this case that only one of the two switching contacts is formed from closed bodies with hollow spaces, and that the other of the two switching contacts is configured as a massive switching contact without hollow spaces. As a result of the massive switching contact being formed without hollow spaces for receiving liquid, the massive switching contact can be produced with a lower assembly effort and thus more cost-effectively. In this case, the one of the two switching contacts formed from closed bodies with hollow spaces is sufficient to effectively receive the liquid.

In one example, the massive switching contact has a first contact thickness, and the switching contact formed from a plurality of closed bodies arranged against one another has a second contact thickness, wherein the second contact thickness is greater than the first contact thickness, and wherein the second contact thickness is in particular more than twice as large as the first contact thickness.

As a result of the second contact thickness of the switching contact with hollow spaces being greater than the first contact thickness of the massive switching contact without hollow spaces, the volume of the switching contact with hollow spaces is significantly greater than if both switching contacts had the same contact thickness. In particular, the first contact thickness is reduced by the same distance by which the second contact thickness is increased so that a consistent total thickness of the first switching contact and the second switching contact is ensured. In the case of a consistent total thickness of the electromechanical switching device, the liquid capacity can be significantly increased through the larger hollow space volume in the switching contact with hollow spaces.

In one example, the closed bodies are configured as closed bodies consisting of metal or as closed bodies with a metal coating, wherein the metal is particularly selected from the group comprising copper, silver, gold or mixtures thereof.

The metals mentioned ensure effective electrically conducting properties of the switching contacts. In particular, the first switching contact and/or the second switching contact have a gold coating.

In one example, the electromechanical switching device comprises a housing which encloses the first and second switching contacts and seals them in an airtight manner, particularly hermetically, with respect to an outer region of the housing, wherein the housing comprises a housing interior, which is in particular filled with a protective gas, wherein the protective gas is particularly selected from the group comprising nitrogen, sulphur hexafluoride, inert gas or mixtures thereof.

The housing, which is filled with protective gas and sealed hermetically with respect to an outer region, reduces the amount of the substances chemically formed when a switch arc occurs and thus reduces the amount of liquid, e.g. nitric acid, touching the switching contacts.

In one example, the at least one switching contact respectively comprises a carrier plate, on which the plurality of closed bodies arranged against one another is formed.

The carrier plate stabilises the arrangement of the closed bodies in the at least one switching contact.

In one example, the carrier plate is deformable in order to bring the first switching contact and the second switching contact into contact.

BRIEF DESCRIPTION OF TILE DRAWINGS

Further examples, of the principles of the present disclosure are explained with reference to the accompanying figures.

DETAILED DESCRIPTION

Figure 1:
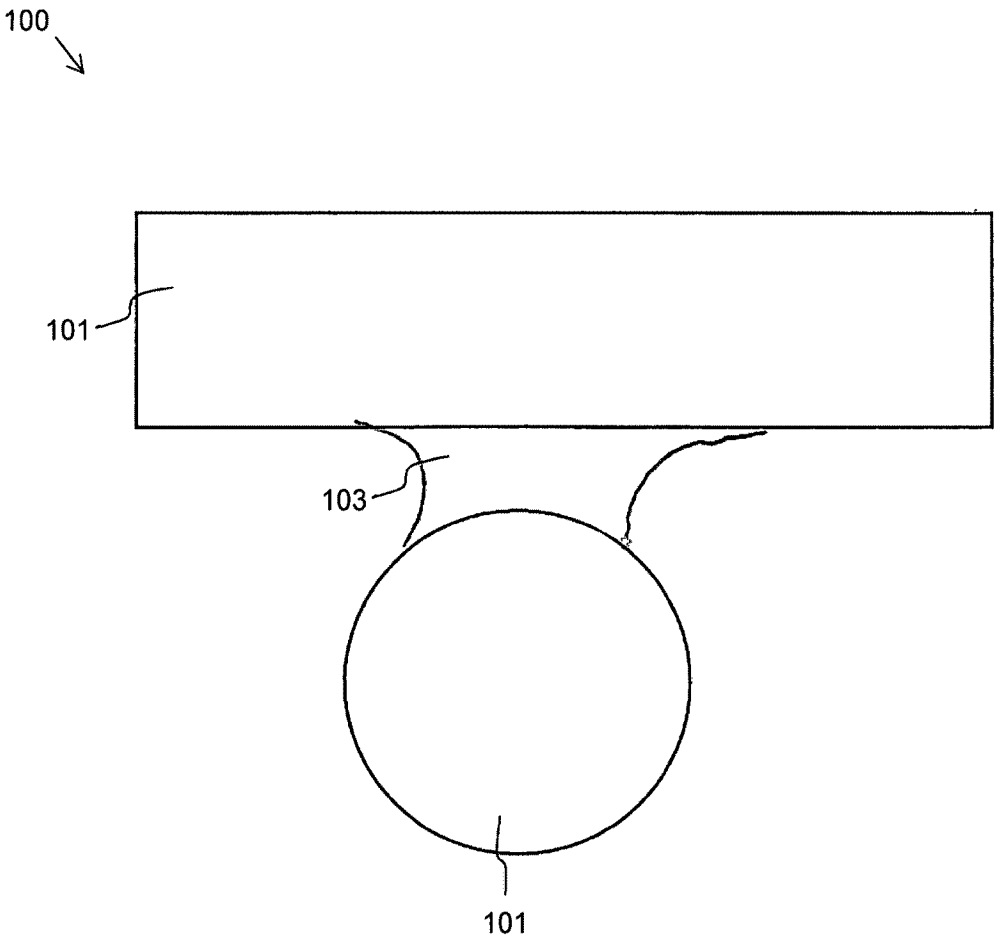
FIG. 1 is a liquid accumulation at switching contacts of an electromechanical switching device.

FIG. 1 shows a liquid accumulation at switching contacts of an electromechanical switching device. The electromechanical switching device 100 comprising switching contacts 101 for closing an electrical circuit is configured, in particular, as a relay with relay contacts.

For electromechanical switching devices 100, in particular relays, a switch arc occurs when switching off inductive loads. This switch arc has a temperature between 5000 Kelvin and 15,000 Kelvin depending on the switched-off load, the geometric properties of the switching contacts 101 and the material properties of the switching contacts 101, as well as the opening speed of the switching contacts 101. Due to this high temperature, a chemical reaction of the components of the internal air of the electromechanical switching device 100 occurs in the switch arc. Oxygen and nitrogen thereby react to nitrogen oxides. The nitrogen oxides in turn react with water, or water vapour, to nitrous acid and nitric acid. The resulting gaseous nitric acid condenses on the metallic switching contacts 101 and reacts with the metallic switching contacts 101, forming metal nitrates. If switching contacts 101 made of copper are used, the nitric acid reacts with the copper, forming copper nitrate and water, and a coloured layer forms on the switching contacts 101. If switching contacts 101 made of silver are used, the nitric acid reacts with the silver, forming silver nitrate and water. If switching contacts 101 made of gold are used, there is no reaction of nitric acid and gold due to the inert properties of gold, so that the nitric acid is precipitated as a liquid precipitate on the switching contacts 101 and remains on the switching contacts 101.

In order to prevent the effect of adhesion of closed switching contacts 101 due to liquid accumulations between the switching contacts 101, conventional switching contacts 101 are typically heated at high temperatures and low pressure, and the interior of a housing surrounding and hermetically sealing the switching contacts 101 is in particular filled with protective gas, such as nitrogen, sulphur hexafluoride or inert gases, such as argon, and sealed in a gas-tight manner. Such an encapsulation of the switching contacts 101 can be complex and has a high requirement for gas-tight closure for a long period of time. However, operating the switching contacts 101 in an opened housing is associated with restrictions in operation, such as no wash tightness and no explosion-proof use.

As shown in FIG. 1, a bridge of liquid 103 thus forms between the switching contacts 101 in the case of closed switching contacts 101 due to a capillary action. In this case, the upper switching contact 101 shown in FIG. 1 in sectional representation is configured as a rectangular contact bar with a rectangular cross-section and the lower switching contact 101 is configured as a round contact bar with a circular cross-section.

The capillary force responsible for the capillary action depends on the geometric properties of the switching contacts 101 and the surface tension of the liquid 103.

Figure 2:
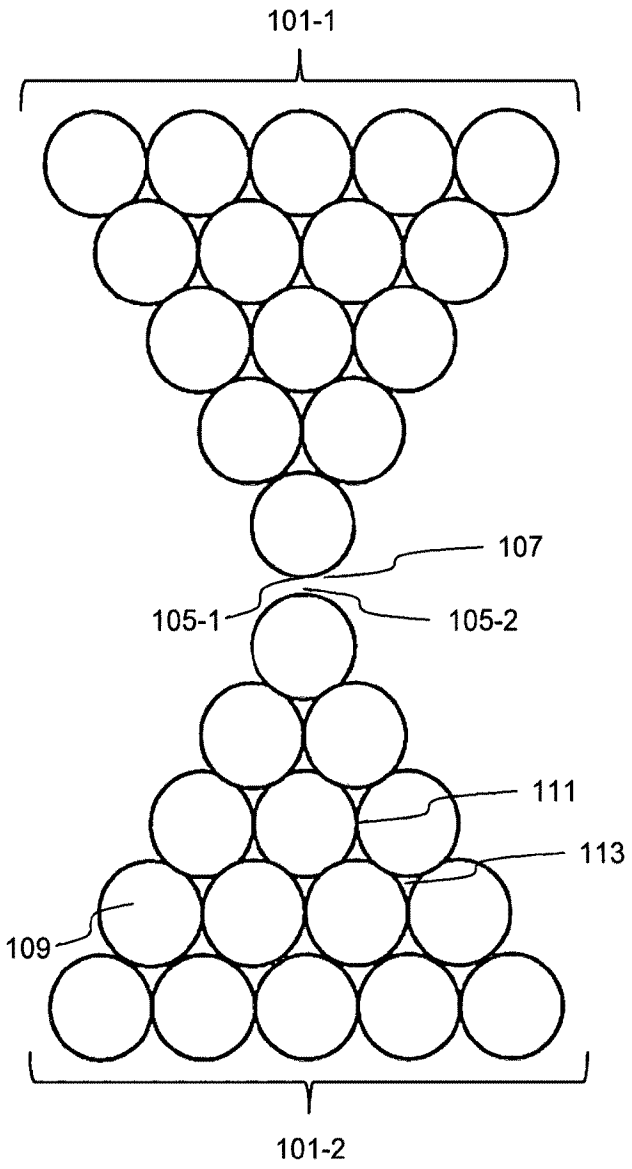
FIG. 2 is switching contacts, configured as pyramids, of an electromechanical switching device according to a first example.

FIG. 2 shows switching contacts, configured as pyramids, of an electromechanical switching device according to a first example in a sectional representation. The switching contacts 101 comprise a first switching contact 101-1 with a first switching contact surface 105-1 and a second switching contact 101-2 with a second switching contact surface 105-2. The first switching contact surface 105-1 and the second switching contact surface 105-2 are brought into contact by a movement of the first and second switching contacts 101-1, 101-2 toward each other in order to close an electrical circuit. In this case, a contact gap 107 is formed between the first switching contact surface 105-1 and the second switching contact surface 105-2.

Both the first switching contact 101-1 and the second switching contact 101-2 are formed from a plurality of closed bodies 109 abutting against one another, wherein hollow spaces 113 for receiving liquid 103 are formed between the closed bodies 109. However, it is also possible for only the first switching contact 101-1 or only the second switching contact 101-2 to be formed from a plurality of closed bodies 109 abutting against one another and for the other of the two switching contacts 101-1, 101-2 to be formed as a massive switching contact without hollow spaces 113 for receiving liquid 103.

The first and second switching contacts 101-1, 101-2 are respectively configured as a pyramid with pyramid tip in accordance with FIG. 2. Through a contact between the first switching contact surface 105-1 arranged on the pyramid tip of the first switching contact 101-1 with the second switching contact surface 105-2 arranged on the pyramid tip of the second switching contact 101-2, the electrical circuit can be closed.

The first and second switching contacts 101-1, 101-2 are foliated from several layers of closed bodies 109 arranged against one another, in particular spherical bodies, wherein the spherical bodies are in particular formed from copper, silver, gold or mixtures thereof, and/or wherein the spherical bodies are coated with copper, silver, gold or mixtures thereof.

Each of the spherical bodies comprises a plurality of body contact surfaces 111, wherein the body contact surfaces 111 are in contact with the body contact surfaces 111 of the adjacent closed bodies 109 inside the first and second switching contacts 101-1, 101-2 and thus delimit hollow spaces 113 for receiving liquid 103 between the closed bodies 109.

The hollow spaces 113 are configured as capillary columns in which the liquid 103 present in the electromechanical switching device 100, such as nitric acid or nitrous acid, accumulates and is received in the hollow spaces 113 through a capillary action. This prevents the liquid 103 from accumulating between the first switching contact surface 105-1 and the second switching contact surface 105-2.

The total area of the touching first switching contact surface 105-1 and the second switching contact surface 105-2 is low as a result of the rounded surfaces in comparison to two touching plates. Consequently, the resulting adhesive forces between the touching first contact surface 105-1 and second switching contact surface 105-2 are also substantially smaller than in the usual contacts with comparatively large radii of the switching contact surfaces 105-1, 105-2.

Due to the small radius of the closed bodies 109 configured as spherical bodies, the capillary action in the hollow spaces 113 is moreover increased so that a viscous liquid 103, such as nitric acid, is also received in the hollow spaces 113 and does not adhere to the switching contact surfaces 105-1, 105-2.

Thus, the example shown in FIG. 2 of the first switching contact 101-1 and of the second switching contact 101-2 can reduce the accumulation of liquid 103, e.g. nitric acid or nitrous acid, between the closed first and second switching contact surfaces 105-1, 105-2. At the same time, the shape of the first and second switching contact surfaces 105-1, 105-2 can be selected such that a very small remaining adhesive force between the first and second switching contact surfaces 105-1, 105-2 occurs.

Figure 3:
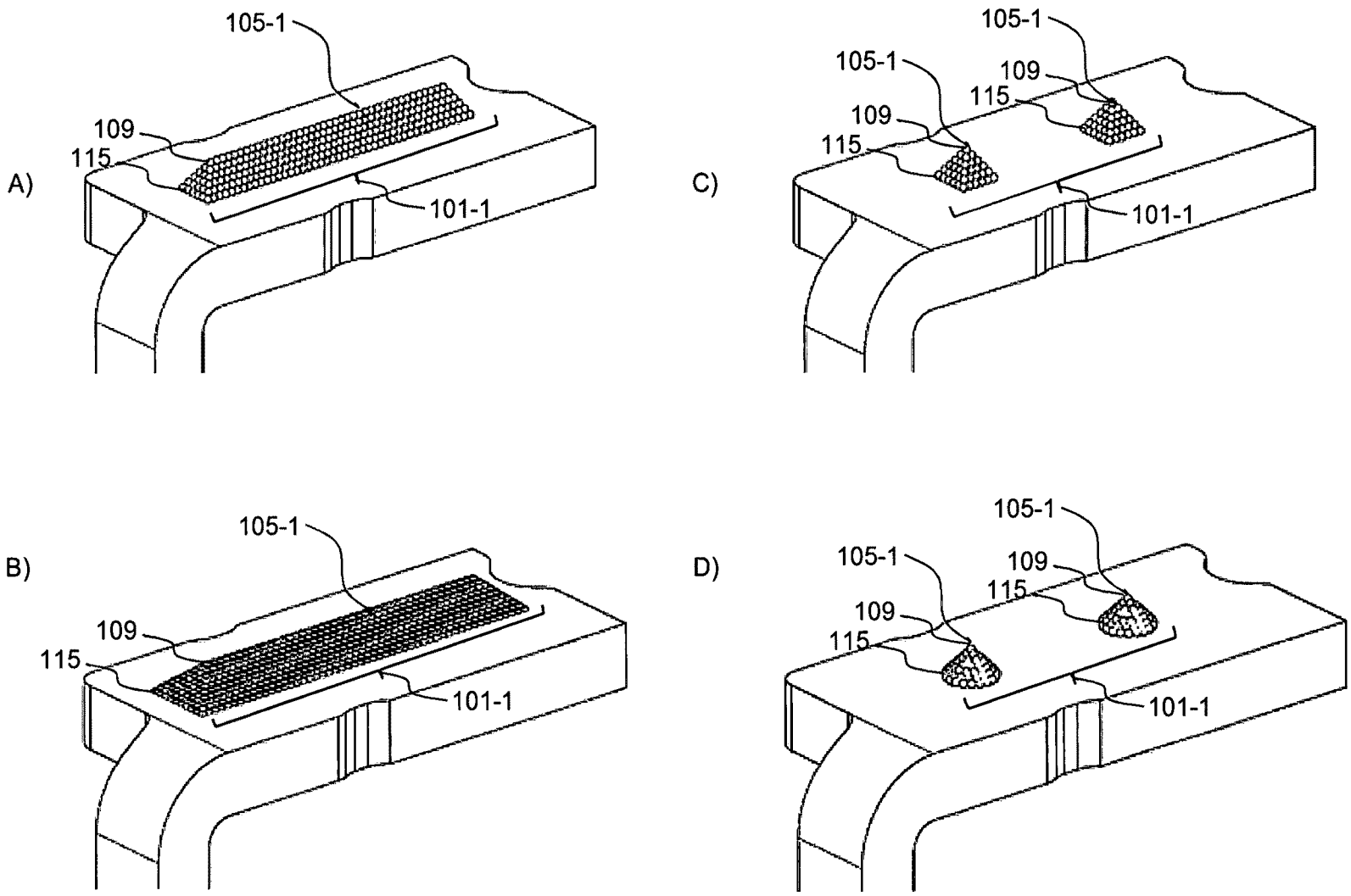
FIGS. 3A, 3B, 3C, and 3D show switching contacts in accordance with further examples.

FIGS. 3A, 3B, 3C, and 3D show switching contacts in accordance with further examples. The switching contacts 101 shown in FIGS. 3A, 3B, 3C, and 3D each show a first switching contact 101-1, wherein the closed bodies 109 in FIGS. 3A, 3B, 3C, and 3D are configured as spherical bodies 109, wherein the closed bodies 109 in FIG. 3B are configured as macaroon-shaped bodies 109, and wherein each body 109 comprises a plurality of body contact surfaces 111, wherein each of the body contact surfaces 111 is in contact with adjacent bodies 109.

FIG. 3A shows a first switching contact 101-1, which can be brought into contact with a second switching contact 101-2 not shown in FIG. 3A in order to close the electrical circuit. The first switching contact 101-1 is formed from layers 115 of closed bodies 109, in particular spherical bodies 109, arranged against one another. The first switching contact 101-1 is configured as a pyramid, in particular a rectangular pyramid, with an upper edge as first switching contact surface 105-1.

FIG. 3B shows a first switching contact 101-1, which can be brought into contact with a second switching contact 101-2 not shown in FIG. 3B in order to close the electrical circuit. The first switching contact 101-1 is formed from layers 115 of closed bodies 109, in particular macaroon-shaped bodies 109, arranged against one another. The first switching contact 101-1 is configured as a pyramid, in particular a rectangular pyramid, with an upper edge as first switching contact surface 105-1.

FIG. 3C shows a first switching contact 101-1, which can be brought into contact with a second switching contact 101-2 not shown in FIG. 3C in order to close the electrical circuit. The first switching contact 101-1 is formed from layers 115 of closed bodies 109, in particular spherical bodies 109, arranged against one another. The first switching contact 101-1 is configured as a double pyramid, which comprises a first pyramid, in particular a square pyramid, with a first pyramid tip, and a second pyramid, in particular a square pyramid, with a second pyramid tip, wherein the first and second pyramid tips form the first switching contact surface 105-1.

FIG. 3D shows a first switching contact 101-1, which can be brought into contact with a second switching contact 101-2 not shown in FIG. 3D in order to close the electrical circuit. The first switching contact 101-1 is formed from layers 115 of closed bodies 109, in particular spherical bodies 109, arranged against one another. The first switching contact 101-1 is configured as a double cone, which comprises a first cone with a first cone tip and a second cone with a second cone tip, wherein the first and second cone tips form the first switching contact surface 105-1.

LIST OF REFERENCE NUMBERS

100 Electromechanical switching device
101 Switching contact
101-1 First switching contact
101-2 Second switching contact
103 Liquid
105-1 First switching contact surface
105-2 Second switching contact surface
107 Contact gap
109 Closed bodies
111 Body contact surface
113 Hollow space
115 Layer of closed bodies

The invention claimed is:

1. An electromechanical switching device, comprising:

a plurality of switching contacts configured to close an electrical circuit, wherein the switching contacts comprise a first switching contact and a second switching contact, wherein the first switching contact and the second switching contact are configured to contact each other to close the electrical circuit, wherein at least one of the switching contacts is formed from a plurality of closed bodies arranged against one another, and wherein hollow spaces configured to receive liquid are arranged between the closed bodies, wherein the at least one switching contact is configured as a cone comprising a cone to surface configured to close the electrical circuit, wherein the cone is formed by a plurality of layers of the closed bodies arranged against one another, and wherein the first switching contact is formed from a first plurality of closed bodies arranged against one another and the second switching contact is formed from a second plurality of closed bodies arranged against one another, and wherein the first plurality of closed bodies comprises a first plurality of hollow spaces arranged between the first plurality of closed bodies and configured to receive the liquid, and wherein the second plurality of closed bodies comprises a second plurality of hollow spaces arranged between the second plurality of closed bodies and configured to receive the liquid.

2. The electromechanical switching device according to claim 1, wherein the first switching contact comprises at least a first switching contact surface, wherein the second switching contact comprises a second switching contact surface, wherein the first switching contact surface and the second switching contact surface are configured to contact each other to close the electrical circuit, and wherein one or more of the first switching contact surface or the second switching contact surface comprises one or more of: a rounded surface, an edge, a tip, or an edge comprising a tip.

3. The electromechanical switching device according to claim 1, wherein the closed bodies are configured as one or more of: pyramids, tetrahedrons, drop-shaped bodies, spheroids, macaroon-shaped bodies, or spherical bodies.

4. The electromechanical switching device according to claim 1, wherein the closed bodies have body contact surfaces, wherein the body contact surfaces of the closed bodies are arranged against one another and in contact inside the at least one of the switching contacts to delimit the hollow spaces arranged between the closed bodies.

5. The electromechanical switching device according to claim 1, wherein the hollow spaces between the closed bodies are configured as capillary columns, and wherein the capillary columns are configured to retain liquid in the capillary columns through a capillary action.

6. The electromechanical switching device according to claim 1, wherein at least one switching contact is configured as a pyramid, which comprises a pyramid tip for closing the electrical circuit, wherein the pyramid is formed from several layers of closed bodies arranged against one another, wherein the pyramid is configured as a tetrahedron, a square pyramid, a five-sided pyramid or a six-sided pyramid.

7. The electromechanical switching device according to claim 1, wherein the cone top surface comprises a cone tip configured to close the electrical circuit.

8. The electromechanical switching device according to claim 7, wherein at least one switching contact is configured as a double cone comprising a first cone comprising a first cone tip configured to close the electrical circuit and a second cone comprising a second cone tip configured to close the electrical circuit.

9. The electromechanical switching device according to claim 1, wherein the closed bodies are configured as metallic closed bodies comprising a metal selected from the group comprising copper, silver, gold or a mixture thereof.

10. The electromechanical switching device according to claim 1, wherein the electromechanical switching device comprises a housing enclosing the first switching contact and the second switching contact and configured to hermetically seal the first switching contact and the second switching contact with respect to an outer region of the housing, wherein the housing comprises a housing interior filled with a protective gas.

11. The electromechanical switching device according to claim 10, wherein the protective gas is selected from the group comprising nitrogen, sulphur hexafluoride, inert gas, or a mixture thereof.

12. The electromechanical switching device according to claim 1, wherein the at least one switching contact respectively comprises a carrier plate on which the plurality of closed bodies arranged against one another is formed.

13. The electromechanical switching device according to claim 12, wherein the carrier plate is configured to deform to bring the first switching contact and the second switching contact into contact.

14. The electromechanical switching device according to claim 1, wherein the closed bodies comprise a metallic coating comprising a metal selected from the group comprising copper, silver, gold, or a mixture thereof.

15. An electromechanical switching device, comprising:

a plurality of switching contacts configured to close an electrical circuit, wherein the switching contacts comprise a first switching contact and a second switching contact, wherein the first switching contact and the second switching contact are configured to contact each other to close the electrical circuit, wherein at least one of the switching contacts is formed from a plurality of closed bodies arranged against one another, and wherein hollow spaces configured to receive liquid are arranged between the closed bodies, wherein only one of the switching contacts is formed from the plurality of closed bodies, wherein the other switching contact is configured as a solid switching contact without any hollow spaces for receiving the liquid, wherein the solid switching contact is configured as a switching contact plate or as a switching contact bar, and wherein the solid switching contact comprises a first contact thickness, and wherein the switching contact formed from the plurality of closed bodies comprises a second contact thickness, wherein the second contact thickness is greater than the first contact thickness.

16. The electromechanical switching device according to claim 15, wherein the second contact thickness is more than twice as large as the first contact thickness.

* * * * *